US009786417B2

(12) United States Patent
Hayashishita et al.

(10) Patent No.: US 9,786,417 B2
(45) Date of Patent: Oct. 10, 2017

(54) MULTI-CORE CABLE AND METHOD OF MANUFACTURING THE SAME

(71) Applicant: SUMITOMO ELECTRIC INDUSTRIES, LTD., Osaka-shi, Osaka (JP)

(72) Inventors: Tatsunori Hayashishita, Hachinohe (JP); Yunfei Zhu, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/448,183

(22) Filed: Jul. 31, 2014

(65) Prior Publication Data

US 2016/0035459 A1 Feb. 4, 2016

(51) Int. Cl.

| | |
|---|---|
| ***H01B 7/18*** | (2006.01) |
| ***H01B 13/26*** | (2006.01) |
| ***H01B 11/10*** | (2006.01) |
| *H01B 11/20* | (2006.01) |

(52) U.S. Cl.

CPC ..... *H01B 13/2606* (2013.01); *H01B 11/1033* (2013.01); *H01B 11/20* (2013.01)

(58) Field of Classification Search

CPC . H01B 5/00; H01B 5/12; H01B 7/183; H01B 7/288

USPC ..... 174/36, 102 R, 103, 106 R, 108, 109, 174/110 R, 113 R

See application file for complete search history.

(56) References Cited

U.S. PATENT DOCUMENTS

| | | | | |
|---|---|---|---|---|
| 3,240,867 | A * | 3/1966 | Maddox | H01B 7/065 174/109 |
| 5,043,530 | A * | 8/1991 | Davies | H01B 7/1895 174/102 R |
| 5,483,020 | A * | 1/1996 | Hardie | H01B 11/203 156/51 |
| 5,767,442 | A * | 6/1998 | Eisenberg | H01B 11/06 174/113 R |
| 6,815,611 | B1 * | 11/2004 | Gareis | H01B 11/1025 174/113 R |
| 2005/0029006 | A1 * | 2/2005 | Takahashi | H01B 11/005 174/102 R |
| 2007/0068696 | A1 | 3/2007 | Matsui et al. | |

(Continued)

FOREIGN PATENT DOCUMENTS

| | | |
|---|---|---|
| CN | 1716463 A | 1/2006 |
| CN | 203706735 U | 7/2014 |

(Continued)

OTHER PUBLICATIONS

Notification of First Office Action issued Oct. 27, 2016 in Chinese Patent Application No. 201410428019.6 (8 pages) with an English Translation (10 pages).

*Primary Examiner* — William H Mayo, III

(74) *Attorney, Agent, or Firm* — Drinker Biddle & Reath LLP

(57) ABSTRACT

In a multi-core cable in which a plurality of small-diameter cables are gathered and a periphery of these small-diameter cables is covered with a shield layer and a periphery of the shield layer is covered with a sheath, the shield layer is formed by braiding a plurality of twisted wires formed by twisting two or three wires, and a twist pitch of the wires is values from 20 to 50 times (both inclusive) an outside diameter of the twisted wire.

5 Claims, 3 Drawing Sheets

(56) References Cited

U.S. PATENT DOCUMENTS

| | | | | |
|---|---|---|---|---|
| 2009/0183897 | A1* | 7/2009 | Plourde | H01B 11/1847 174/120 R |
| 2014/0311758 | A1 | 10/2014 | Varkey et al. | |

FOREIGN PATENT DOCUMENTS

| | | | | | |
|---|---|---|---|---|---|
| JP | A-H10-326525 | | | 12/1998 | |
| JP | 11086642 | | * | 3/1999 | H01B 7/04 |
| JP | A-H11-086642 | | | 3/1999 | |
| JP | A-2003-132745 | | | 5/2003 | |
| JP | 2005-197036 | | * | 7/2005 | H01B 7/17 |
| JP | 2005-197036 | A | | 7/2005 | |
| JP | 2007-172928 | A | * | 5/2007 | H01B 7/00 |
| WO | WO-2013-082244 | A1 | | 6/2013 | |

* cited by examiner

MULTI-CORE CABLE AND METHOD OF MANUFACTURING THE SAME

TECHNICAL FIELD

The present invention relates to a multi-core cable in which plural small-diameter cables are gathered and integrated, and a method of manufacturing the multi-core cable.

RELATED ART

A multi-core cable having a shield layer formed by braiding six stranded wires with an outside diameter of 0.12 mm made of an Sn-plated annealed copper wire has been known as a shielded multi-core cable formed by covering the periphery of one or plural insulated electronic wires with a shield layer and a sheath (for example, see Patent Literature 1).

LITERATURE OF RELATED ART

Patent Literature

[Patent Literature 1] JP-A-2005-197036

In the cable described above, mechanical strength such as bending resistance or tensile strength of the shield layer is increased by using the shield layer in which small-diameter wires are braided in a tubular shape.

In recent years, the multi-core cable requires higher mechanical reliability of bendability, twistability, etc.

SUMMARY

The invention provides a multi-core cable and a method of manufacturing the multi-core cable in which mechanical reliability of bendability, twistability, etc. can be improved.

A multi-core cable of the invention is a multi-core cable in which a plurality of small-diameter cables are gathered and a periphery of these small-diameter cables is covered with a shield layer and a periphery of the shield layer is covered with a sheath, wherein the shield layer is formed by braiding a plurality of twisted wires formed by twisting two or three wires, and a twist pitch of the wires is values from 20 to 50 times (both inclusive) an outside diameter of the twisted wire.

A method of manufacturing a multi-core cable according to an embodiment of the invention, comprises:

gathering a plurality of small-diameter cables;

preparing a plurality of twisted wires formed by twisting two or three wires, in which a twist pitch of the wires is values from 20 to 50 times (both inclusive) an outside diameter of the twisted wire;

forming a shield layer by braiding the plurality of twisted wires on a periphery of the plurality of small-diameter cables which are gathered; and covering a periphery of the shield layer with a sheath made of a resin.

According to the invention, mechanical reliability of bendability, twistability, etc. of the multi-core cable can be improved.

DETAILED DESCRIPTION

Description of Embodiment of the Invention

First, the contents of an embodiment of the invention of the present application will be listed and described.

A multi-core cable according to an embodiment of the invention is (1) a multi-core cable in which a plurality of small-diameter cables are gathered and a periphery of these small-diameter cables is covered with a shield layer and a periphery of the shield layer is covered with a sheath, wherein the shield layer is formed by braiding a plurality of twisted wires formed by twisting two or three wires, and a twist pitch of the wires is values from 20 to 50 times (both inclusive) an outside diameter of the twisted wire.

It is possible to improve mechanical reliability of bendability, twistability, etc. of the multi-core cable while preventing a lift of the wire at the time of braiding the shield layer.

(2) It is preferable that the twist pitch of the wires is values from 25 to 50 times (both inclusive) the outside diameter of the twisted wire.

It is possible to provide the multi-core cable having more excellent durability with respect to bendability and twistability.

(3) It is preferable that a diameter of the wire is 0.05 mm or less.

It is possible to decrease strain of the wire at the time of bending the multi-core cable 11 and to suppress a break in the shield layer.

(4) It is preferable that the wire is a silver-plated copper-silver alloy wire.

It is preferably used as the shield layer of the multi-core cable with the improved bendability, twistability, etc.

A method of manufacturing a multi-core cable according to an embodiment of the invention, comprises:

(5) gathering a plurality of small-diameter cables;

preparing a plurality of twisted wires formed by twisting two or three wires, in which a twist pitch of the wires is values from 20 to 50 times (both inclusive) an outside diameter of the twisted wire;

forming a shield layer by braiding the plurality of twisted wires on a periphery of the plurality of small-diameter cables which are gathered; and covering a periphery of the shield layer with a sheath made of a resin.

It is possible to manufacture a multi-core cable having an excellent durability with respect to bendability and twistability.

Details of Embodiment of the Invention

An exemplary embodiment of a multi-core cable and a method of manufacturing the multi-core cable according to the present invention will hereinafter be described with reference to the drawings.

Figure 1:
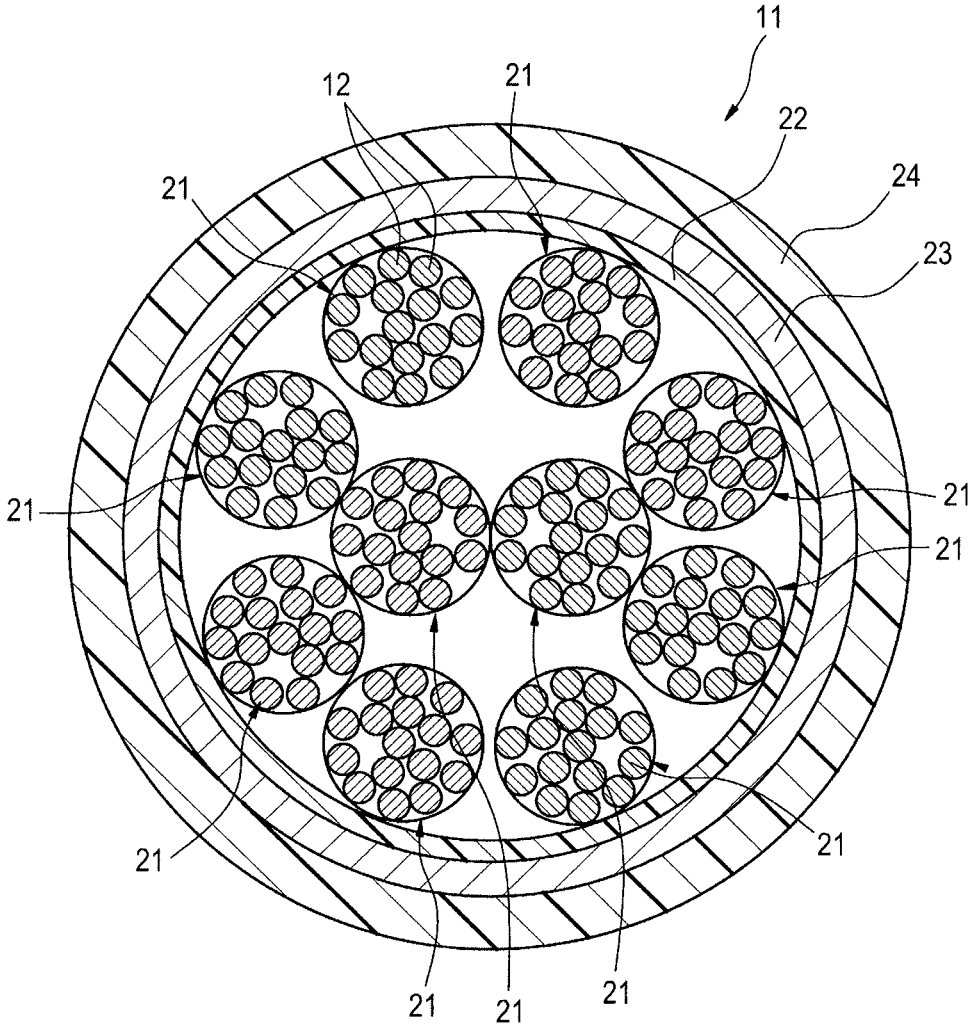
FIG. 1 is a sectional view of a multi-core cable according to an embodiment.

As shown in FIG. 1, a multi-core cable 11 according to the embodiment has plural (10 in the present example) multi-core units 21, and these multi-core units 21 are gathered while being stranded, and bundled. Each of these multi-core units 21 is formed by stranding plural (for example, 16) small-diameter cables 12 and has an outside diameter of, for example, 1.65 mm. In the small-diameter cables 12, six small-diameter cables 12 are gathered in a central part and ten small-diameter cables are arranged in an outer layer concentrically in a cross section perpendicular to a length direction of the cables. These plural multi-core units 21 are bundled by loosely winding a resin tape 22 on the outer periphery of the multi-core units 21. In the multi-core cable 11, the outer peripheral side of the bundled multi-core units 21 is covered with a shield layer 23 and the outer peripheral side of this shield layer 23 is further covered with a sheath 24.

The small-diameter cable 12 is a coaxial electronic wire or an insulated electronic wire with an outside diameter of, for example, 0.35 mm. In the coaxial electronic wire, the periphery of a central conductor is covered with an insulator, and an outer conductor is arranged on the periphery of the insulator in a layer shape, and the periphery of the outer conductor is covered with an insulator. The outer conductor is many metal thin wires wound spirally or a metal tape wound. In the insulated electronic wire, a conductor is covered with an insulator. For the coaxial electronic wire, a wire of about AWG 40 in conformity with standards of AWG (American Wire Gauge) is used, and for the insulated electronic wire, a wire of about AWG 32 is used.

As the resin tape 22, a polytetra fluoroethylene (PTFE) sheet is used. An outside diameter of a bundle of the plural multi-core units 21 with this resin tape 22 wound is, for example, 5.4 mm.

Figure 2:
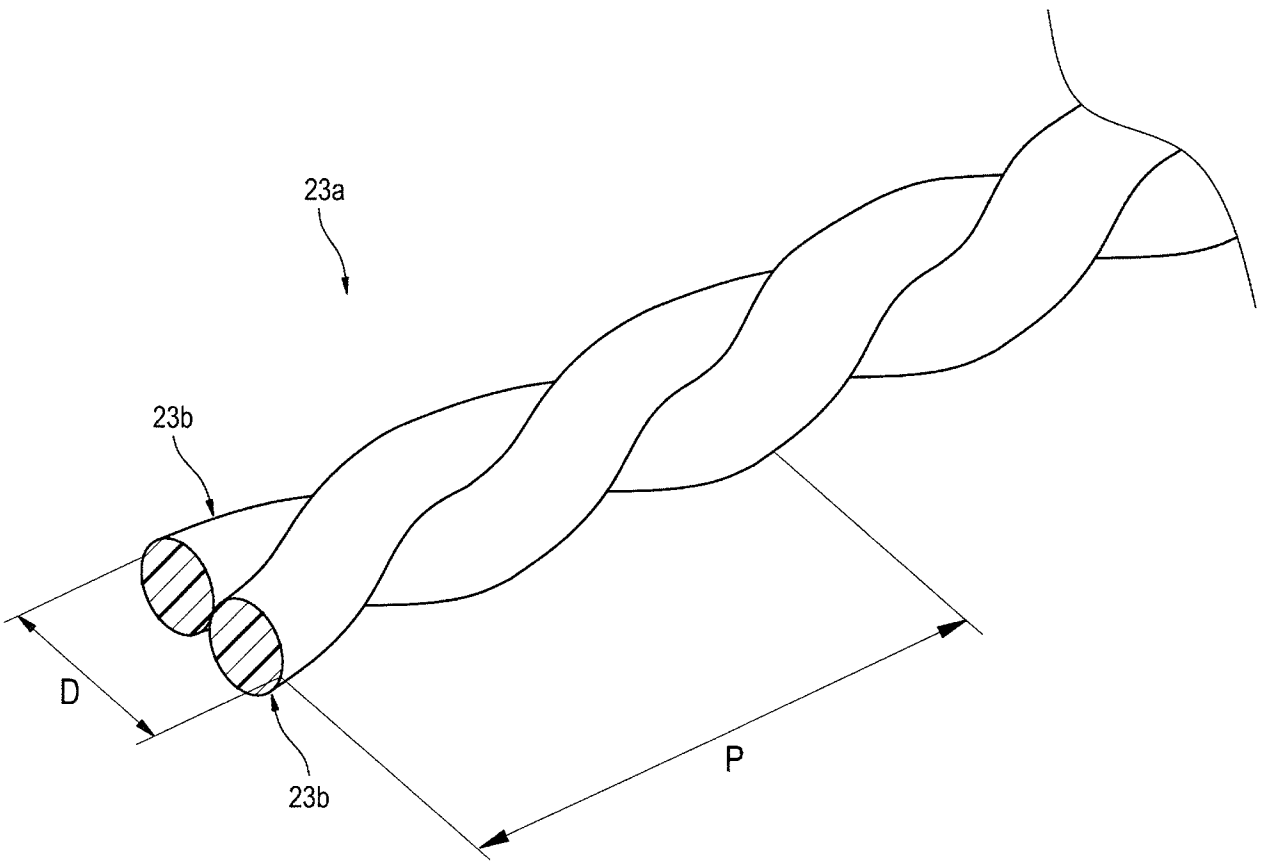
FIG. 2 is a schematic side view of a twisted wire constructing a shield layer provided in the multi-core cable of FIG. 1.

The shield layer 23 is formed by braiding using plural twisted wires 23*a* shown in FIG. 2, and has an outside diameter of, for example, about 5.9 mm. The twisted wire 23*a* is formed by twisting at least two wires 23*b* which are silver-plated copper-silver alloy wires. The twisted wire 23*a* is preferably formed by twisting two or three wires 23*b*. An outside diameter of the wire 23*b* is smaller than that of a wire (a wire diameter: 0.12 mm) used in a shield layer of a conventional multi-core cable, and is preferably, for example, 0.05 mm or less. Also, the wires 23*b* are twisted so that a twist pitch P of the wires 23*b* becomes values from 20 to 50 times (both inclusive) an outside diameter D of the twisted wire 23*a*, preferably, values from 25 to 50 times (both inclusive). Here, the twist pitch P indicates a distance traveling at the time when the wire 23*b* winds one round along an axial direction of the twisted wire 23*a*. The outside diameter D of the twisted wire 23*a* shows an outside diameter at the time when at least two wires 23*b* are twisted. When the twist pitch P of the wires 23*b* is less than 20 times the outside diameter D of the twisted wire 23*a*, bendability of the shield layer 23 is not improved. When the twist pitch P is more than or equal to 25 times the outside diameter D, the bendability is improved more. When the twist pitch P of the wires 23*b* is more than 50 times the outside diameter D of the twisted wire 23*a*, at the time of braiding, the wire is lifted and a ratio of a non-defective product becomes worse extremely.

The sheath 24 is formed of a soft synthetic resin having elasticity, for example, polyvinyl chloride (PVC). An outside diameter of the multi-core cable 11 configured in this manner is, for example, about 8.3 mm.

Next, a method of manufacturing the multi-core cable 11 of the embodiment will be described.

First, plural small-diameter cables 12 are stranded and gathered to form a multi-core unit 21. Next, the plural multi-core units 21 are stranded and gathered.

Then, the multi-core units 21 are bundled by winding a resin tape 22 on the periphery of the plural multi-core units 21 gathered. This resin tape 22 is started to be wound from one end side of the gathered multi-core units 21 and is spirally wound toward the other end side. After the resin tape 22 is wound, the plural multi-core units 21 are maintained in a bundled state.

Then, as shown in FIG. 2, at least two wires 23*b* with an outside diameter of, for example, 0.05 mm are twisted to form a twisted wire 23*a*. At this time, the wires are twisted so that a twist pitch P of the wires 23*b* becomes values from 20 to 50 times (both inclusive) an outside diameter D of the twisted wire 23*a*. Then, a shield layer 23 is formed by braiding the twisted wires 23*a* on the outer periphery of the multi-core units 21.

Subsequently, the outer periphery of a bundle of the multi-core units 21 covered with the shield layer 23 is covered with a resin used as a sheath by extrusion to thereby form a sheath 24. In this manner, a multi-core cable 11 in which the bundle of the multi-core units 21 is sequentially covered with the shield layer 23 and the sheath 24 is completed.

According to the multi-core cable 11 according to the embodiment described above, as the shield layer 23 is formed by braiding the twisted wires 23*a* formed by twisting at least two wires 23*b*, a diameter of the wire may be made smaller than ever before. Accordingly, strain of the wire 23*b* at the time of bending the multi-core cable 11 is decreased, and durability with respect to bending or flexure is improved since the wire constructing the shield layer 23 is the twisted wire. Accordingly, a break in the shield layer 23 can be suppressed. Also, since the twist pitch P of the wires 23*b* is values from 20 to 50 times (both inclusive) the outside diameter D of the twisted wire 23*a*, mechanical reliability of bendability, twistability, etc. of the multi-core cable 11 can be improved while preventing a lift of the wire at the time of braiding.

EXAMPLE

Multi-core cables of the following Examples 1 to 4 and Comparative Examples 1 to 3 were prepared, and twist and bend tests on the respective multi-core cables were conducted.

(1) Twist and Bend Test Method

Figure 3:
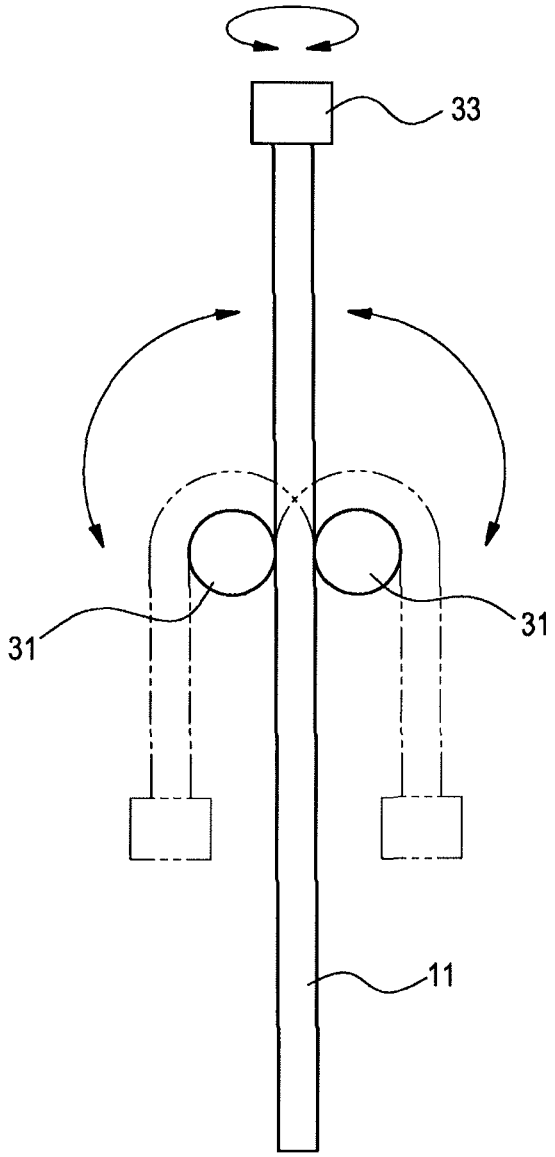
FIG. 3 is a diagram showing a situation of a twist and bend test.

As shown in FIG. 3, a multi-core cable 11 was inserted between a pair of mandrels 31, and the multi-core cable 11 was drooped with its own weight (about 1 kg), and the upper end of the multi-core cable 11 was gripped with a chuck 33. While the chuck 33 was spun 360° from side to side around the axis of the multi-core cable 11, the chuck 33 was swung like a pendulum along the circumference around a gap between the mandrels 31 and thereby, the multi-core cable 11 was bent 180° to the respective mandrels 31 sides. A diameter of the mandrel 31 was set at 25 mm. The twist and bend tests were conducted 300000 times in total, and the presence or absence of a break in the wire constructing a shield layer 23 was examined.

(2) Test Specimen

Example 1

In Example 1, a shield layer was formed by braiding twisted wires formed by twisting two wires with an outside diameter of 0.05 mm made of a silver-plated copper-silver alloy wire. A twist pitch of the wires was set at 20 times a diameter of the twisted wire, and a braiding density was set at 95% or more. The braiding density indicates a ratio of the area of a portion covered by the twisted wires constructing the shield layer to the area of an inner surface of the shield layer. The braiding density is determined by a braiding angle, and the number of ends and the number of spindles of the twisted wire. In Example 1, the number of ends of a braiding configuration was set at 12 and the number of spindles was set at 24.

A unit was formed by stranding sixteen coaxial electronic wires (an outside diameter of 0.35 mm) in which the size of a central conductor was AWG 42, and ten units were stranded and were wrapped by a fluorine resin tape. This resin tape was covered with the shield layer, and the shield layer was covered with a polyvinyl chloride (PVC) tube, and a multi-core cable was formed.

Example 2

In Example 2, a shield layer was formed by braiding twisted wires formed by twisting two wires with an outside diameter of 0.05 mm made of a silver-plated copper-silver alloy wire. A twist pitch of the wires was set at 25 times a diameter of the twisted wire, and a braiding density was set at 95% or more. Like Example 1, the number of ends of a braiding configuration of Example 2 was set at 12 and the number of spindles was set at 24. Except for the shield layer, a cable structure was similar to that of Example 1.

Example 3

In Example 3, a shield layer was formed by braiding twisted wires formed by twisting two wires with an outside diameter of 0.05 mm made of a silver-plated copper-silver alloy wire. A twist pitch of the wires was set at 50 times a diameter of the twisted wire, and a braiding density was set at 95% or more. Like Example 1, the number of ends of a braiding configuration of Example 3 was set at 12 and the number of spindles was set at 24. Except for the shield layer, a cable structure was similar to that of Example 1.

Example 4

In Example 4, a shield layer was formed by braiding twisted wires formed by twisting two wires with an outside diameter of 0.03 mm made of a silver-plated copper-silver alloy wire. A twist pitch of the wires was set at 25 times a diameter of the twisted wire, and a braiding density was set at 95% or more. The number of ends of a braiding configuration was set at 18 and the number of spindles was set at 24. Except for the shield layer, a cable structure was similar to that of Example 1.

Comparative Example 1

In Comparative Example 1, a shield layer was formed by braiding a single wire with an outside diameter of 0.08 mm made of a silver-plated copper-silver alloy wire. Similarly, in a braiding configuration of Comparative Example 1, the number of ends was 12 and the number of spindles was 24, and a braiding density was set at 95% or more. Except for the shield layer, a cable structure was similar to that of Example 1.

Comparative Example 2

In Comparative Example 2, a shield layer was formed by braiding twisted wires formed by twisting two wires with an outside diameter of 0.05 mm made of a silver-plated copper-silver alloy wire. A twist pitch of the wires was set at 15 times a diameter of the twisted wire. Also, in a braiding configuration of Comparative Example 2, the number of ends was 12 and the number of spindles was 24, and a braiding density was set at 95% or more. Except for the shield layer, a cable structure was similar to that of Example 1.

Comparative Example 3

In Comparative Example 3, a shield layer was formed by braiding twisted wires formed by twisting two wires with an outside diameter of 0.05 mm made of a silver-plated copper-silver alloy wire. A twist pitch of the wires was set at 60 times a diameter of the twisted wire. Also, in a braiding configuration of Comparative Example 3, the number of ends was 12 and the number of spindles was 24, and a braiding density was set at 95% or more. Except for the shield layer, a cable structure was similar to that of Example 1.

In addition, shielding characteristics of the shield layer are equal since the braiding density is 95% or more in all of Examples 1 to 4 and Comparative Examples 1 to 3.

(3) Test Result

In Examples 1 to 4, a break in the shield layer was not observed after 300000 times bending tests were conducted. Particularly, in Examples 2 to 4, the break in the shield layer was not observed even after the 400000 times bending tests were conducted. On the other hand, in Comparative Examples 1 to 3, a break in the shield layer was observed after the 300000 times bending tests were conducted. Also, in Comparative Example 3, the wire was lifted and also, external appearance was poor. As a result, it could be checked that Examples 1 to 4, Particularly, Examples 2 to 4 had better resistance properties of bendability and twistability than those of Comparative Examples 1 to 3.

The invention has been described above in detail with reference to the specific embodiment, but it is apparent to those skilled in the art that various changes or modifications can be made without departing from the spirit and scope of the invention. Also, the number of components, the position, the shape, etc. of the components described above are not limited to those of the embodiment described above, and can be changed to the number of components, positions, shapes, etc. suitable to carry out the invention.

What is claimed is:

1. A multi-core cable in which a plurality of cables are gathered and a periphery of the cables is covered with a shield layer and a periphery of the shield layer is covered with a sheath, wherein the shield layer is formed by braiding only a plurality of twisted wires, each twisted wire formed by twisting only two or three wires, each twisted wire consisting of silver-copper alloy, wherein a twist pitch of the wires is values from 20 to 50 times (both inclusive) an outside diameter of the twisted wire.

2. The multi-core cable as claimed in claim 1, wherein the twist pitch of the wires is values from 25 to 50 times (both inclusive) the outside diameter of the twisted wire.

3. The multi-core cable as claimed in claim 1, wherein each wire has a diameter of 0.05 mm or less.

4. A method of manufacturing a multi-core cable, comprising:

gathering a plurality of cables;

preparing a plurality of twisted wires formed by twisting only two or three wires consisting of silver-copper alloy, in which a twist pitch of the wires is values from 20 to 50 times (both inclusive) an outside diameter of the twisted wire;

forming a shield layer by braiding only the plurality of twisted wires on a periphery of the plurality of cables which are gathered; and covering a periphery of the shield layer with a sheath made of a resin.

5. The method as claimed in claim 4, wherein each wire has a diameter of 0.05 mm or less.

* * * * *